US007556011B2

(12) United States Patent
Kishihara et al.

(10) Patent No.: US 7,556,011 B2
(45) Date of Patent: Jul. 7, 2009

(54) VALVE STRUCTURE FOR INTERNAL COMBUSTION

(75) Inventors: Ryuji Kishihara, Kyoto-fu (JP); Keiichiro Teratoko, Kyoto-fu (JP); Tadashi Saito, Kyoto-fu (JP); Takao Suzuki, Aichi-ken (JP); Futoshi Fujiwara, Aichi-ken (JP)

(73) Assignees: Suncall Corporation (JP); Toyota Jidosha Kabushiki Kaisha (JP)

( * ) Notice: Subject to any disclaimer, the term of this patent is extended or adjusted under 35 U.S.C. 154(b) by 78 days.

(21) Appl. No.: 11/757,855

(22) Filed: Jun. 4, 2007

(65) Prior Publication Data

US 2007/0277769 A1 Dec. 6, 2007

(30) Foreign Application Priority Data

Jun. 6, 2006 (JP) ..... 2006-157357

(51) Int. Cl.
*F01P 1/06* (2006.01)
*B21K 1/22* (2006.01)
*F16K 1/42* (2006.01)

(52) U.S. Cl. ..... 123/188.3; 123/188.8; 123/41.34; 29/888.4; 29/888.45; 251/356; 251/359

(58) Field of Classification Search ..... 123/188.2, 123/188.3, 188.8, 41.34; 251/318, 356, 367, 251/368; 29/888.4, 888.45
See application file for complete search history.

(56) References Cited

U.S. PATENT DOCUMENTS 1,714,690 A * 5/1929 Nevins ..... 219/105
2,089,749 A * 8/1937 Jardine ..... 123/41.16
2,354,947 A * 8/1944 Colwell ..... 123/188.3
3,073,294 A * 1/1963 Brown et al. ..... 123/188.3
4,169,488 A * 10/1979 Goloff et al. ..... 137/340
6,263,849 B1 * 7/2001 Bonesteel et al. ..... 123/90.51
2002/0066432 A1 * 6/2002 Ruhland et al. ..... 123/188.3
2007/0241302 A1 * 10/2007 Kishihara et al. ..... 251/337

FOREIGN PATENT DOCUMENTS

JP 57-010720 1/1982
JP 58-144008 U 9/1983

(Continued)

OTHER PUBLICATIONS

Kishihara et al., U.S. Appl. No. 11/735,410, filed Apr. 13, 2007.

(Continued)

*Primary Examiner*—Michael Cuff
*Assistant Examiner*—Ka Chun Leung
(74) *Attorney, Agent, or Firm*—Sterne, Kessler, Goldstein & Fox P.L.L.C.

(57) ABSTRACT

A sealing region where a valve seat and an outer peripheral surface of a enlarged diameter portion of a flare portion are contacted to each other is configured so that an end on a side opposite a combustion chamber is positioned at a position same as or on a side away from the combustion chamber than an end on a side close to the combustion chamber of a connecting region where a lid member and an inner peripheral surface of the enlarged diameter portion are connected with respect to the axis line direction.

5 Claims, 6 Drawing Sheets

FOREIGN PATENT DOCUMENTS

| | | | |
|---|---|---|---|
| JP | 59-196503 | U | 12/1984 |
| JP | 3-123914 | | 12/1991 |
| JP | 5-50008 | | 7/1993 |
| JP | 2001-59408 | | 3/2001 |
| JP | 2001-164909 | | 6/2001 |
| JP | 2002-180811 | | 6/2002 |
| JP | 2004-060616 | | 2/2004 |
| JP | 2006-144732 | | 6/2006 |
| WO | WO 00/47876 | | 8/2000 |

OTHER PUBLICATIONS

Office Action, Japanese Patent Office, mailed May 2, 2008, for Japanese Patent Application No. 2006-112484 corresponding to U.S. Appl. No. 11/735,410.

Translation of Office Action, Japanese Patent Office, mailed May 2, 2008, for Japanese Application No. 2006-112484 corresponding to U.S. Appl. No. 11/735,410.

* cited by examiner

VALVE STRUCTURE FOR INTERNAL COMBUSTION

BACKGROUND OF THE INVENTION

1. Field of the Invention

The present invention relates to a valve structure applied to an internal combustion engine such as an automobile engine, two-wheeled vehicle engine, utility engine or the like.

2. Related Art

There has been proposed a technology in which a valve inserted into each of a fuel gas supply line and a fuel gas discharge line in an internal combustion engine as a switching valve is made into a hollow shape and a coolant is enclosed into a hollow portion of the valve (see, for example, Japanese Laid-Open Utility Model Publication No. (1993)-50008).

Specifically, the valve disclosed in the above publication includes a hollow stem member having a shaft portion and a flare portion enlarged from the shaft portion, and a lid member welded to the flare portion so as to close the hollow portion of the stem member.

It is possible to reduce the weight of the valve by making the valve into a hollow shape as described above, thereby compacting and simplifying a coil spring for biasing the valve and a valve driving mechanism for moving the valve against a biasing force of the coil spring.

However, the conventional hollow valve does not appropriately account for elastic deformation of the valve during the combusting operation of the internal combustion engine.

That is, the valve is normally exposed to high temperature of about 450° C. when provided in the fuel gas supply line and of about 800° C. when provided in the fuel gas discharge line during the combusting operation of the internal combustion engine.

However, although the conventional valve is configured to enclose the metal natrium within the hollow portion to alleviate the temperature rise of the valve itself so that elastic deformation of the valve is prevented, it is difficult to alleviate the temperature rise to the level at which the thermal deformation of the valve is not caused only by the function of the metal natrium.

In particular, if the hollow portion is closed by welding as in the conventional valve, the internal pressure of the hollow portion is rapidly raised as the temperature is raised. The rise of the internal pressure may cause the valve to elastically deform in a large amount.

Furthermore, the pressure of the combustion chamber is raised to about 80 atm. That is, the valve may elastically deform due to the pressure rise of the combustion chamber in addition to the elastic deformation due to the temperature rise of the valve itself. In particular, in a case where the valve is made into the hollow shape, the valve has a risk of elastically deforming a large amount along the axial line direction by the pressure of the combustion chamber.

In consideration of such elastic deformation of the valve, there is provided a clearance between the valve driving mechanism and the external end of the valve. However, if the clearance is excessively wide, there is posed an inconvenience of increasing the noise when the valve driving mechanism presses the valve.

On the other hand, if the clearance is too small, the valve driving mechanism is pushed up by the valve due to the elastic deformation of the valve, resulting in damaging a cam member forming the valve driving mechanism and the like.

SUMMARY OF THE INVENTION

In consideration of the above prior art, it is an object of the present invention to provide a valve structure for internal combustion having a simplified structure, the valve structure including a hollow valve and capable of suppressing an elastic deformation of the hollow valve along an axial line direction as much as possible during the combusting operation of the internal combustion engine.

In order to achieve this object, the present invention provides a valve structure for internal combustion including a valve mounted at a cylinder head in a movable manner along an axis line direction so as to cut off between a combustion chamber and a gas line when sitting on a valve seat provided at the cylinder head and fluidly connect between the combustion chamber and the gas line when being away from the valve seat, and a coil spring biasing the valve toward the valve seat, the valve structure being configured so as to fluidly connect between the combustion chamber and the gas line when a valve driving mechanism that is disposed so as to push an external end on a side opposite the combustion chamber of the valve moves the valve toward a side close to the combustion chamber against a biasing force of the coil spring, and fluidly disconnect between the combustion chamber and the gas line when the pushing force by the valve driving mechanism is not applied to the valve and the valve is sit on the valve seat by the biasing force of the coil spring.

The valve has a hollow stem member including a shaft portion that is directly or indirectly inserted in a movable manner along the axis line direction into an axial line hole formed in the cylinder head and a flare portion that extends toward a side close to the combustion chamber and that has a free end being an open end, and a lid member connected to the stem member by caulking so as to close the open end.

The flare portion includes an enlarged diameter portion having a diameter becoming larger as extending toward the side close to the combustion chamber and configured so that an outer peripheral surface configured is capable of contacting to the valve seat, and a reduced diameter portion extending from the enlarged diameter portion toward the side close to the combustion chamber with a flexion point in between.

The lid member is sandwiched by the enlarged diameter portion and the reduced diameter portion.

A sealing region where the valve seat and the outer peripheral surface of the enlarged diameter portion are contacted to each other is configured so that an end on a side opposite the combustion chamber is positioned at a position same as or on a side away from the combustion chamber than an end on a side close to the combustion chamber of a connecting region where the lid member and an inner peripheral surface of the enlarged diameter portion are connected with respect to the axis line direction.

According to the configuration, it is possible to suppress the elastic deformation toward the radially outward direction of the lid member during the combusting operation of the internal combustion engine, thereby reducing the elastic deformation amount of the valve toward the other side along the axis line direction (a side away from the combustion chamber) as much as possible.

Consequently, it is possible to effectively prevent unintentional force from applying from the valve to the valve driving mechanism, while shortening the clearance between the other end along the axis line direction of the valve and the valve driving mechanism acting on the other end to reduce the noise caused by the valve driving mechanism.

Preferably, the sealing region may be configured so that the end on the side opposite the combustion chamber is positioned at a position same as or away from the combustion chamber than an end on a side opposite the combustion chamber of the connecting region with respect to the axis line direction.

Preferably, an end on a side close to the combustion chamber of the sealing region may be closer to the combustion chamber than the end on a side opposite the combustion chamber of the connecting region with respect to the axis line direction.

Preferably, the valve structure for internal combustion further includes a buffering member inserted between the lid member and the internal peripheral surface of the enlarged diameter portion, the buffering member capable of absorbing the elastic deformation toward the radially outward direction of the lid member.

Preferably, the valve structure for internal combustion further includes a powder coolant accommodated in an internal space defined by the stem member and the lid member.

BRIEF DESCRIPTION OF THE DRAWINGS

The above features and advantages of the present invention will become apparent from the detailed description thereof in conjunction with the accompanying drawings herein.

DETAILED DESCRIPTION OF THE PREFERRED EMBODIMENTS

A preferred embodiment of a valve structure for internal combustion according to the present invention will now be described with reference to the accompanying drawings.

Figure 1:
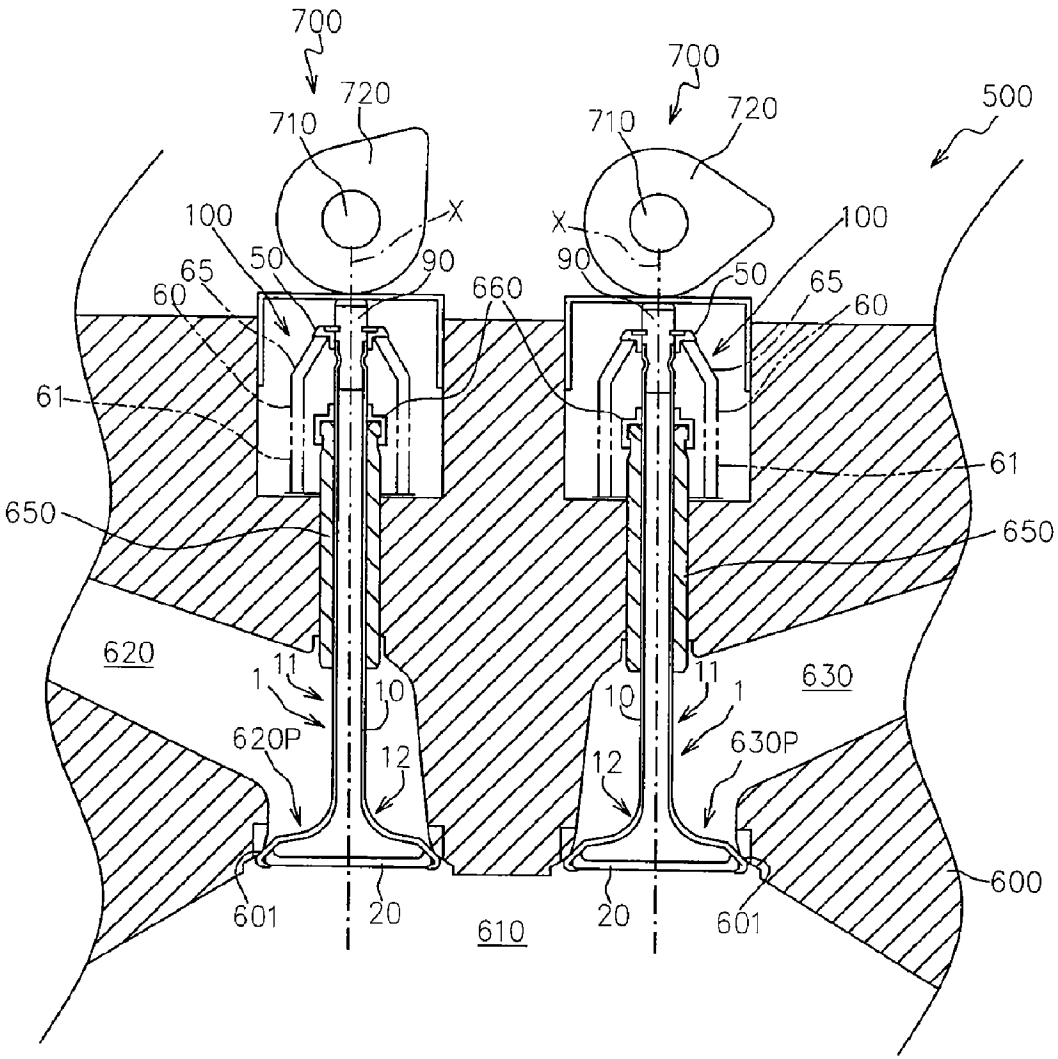
FIG. 1 is a partial schematic cross sectional view showing one example of an internal combustion engine to which a valve structure for internal combustion according to one embodiment of the present invention is applied.

FIG. 1 is a partial schematic cross sectional view showing one example of an internal combustion engine 500 to which a valve structure for internal combustion 100 according to the present embodiment is applied.

The internal combustion engine 500 shown in FIG. 1 includes a cylinder head 600 formed with a combustion chamber 610, a fuel gas supply line 620 for supplying fuel gas to the combustion chamber 610 and a fuel gas discharge line 630 for discharging the gas that has been combusted in the combustion chamber 610, and the valve structure for internal combustion 100 is applied to the cylinder head 600.

The valve structure for internal combustion 100 includes valves 1 mounted at the cylinder head 600 in a movable manner along its axial line direction so as to perform a control of fluid-communication or cutoff of the fuel gas supply line 620 and the fuel gas discharge line 630, and coil springs 60 biasing the corresponding valve 1. In the valve structure 100, when a valve driving mechanism 700 that is disposed so as to push an external end (an end on a side opposite the combustion chamber 610) of the corresponding valve 1 moves the valve 1 toward one side (a side close to the combustion chamber) along the axial line direction against a biasing force of the coil spring 60, the corresponding gas line 620, 630 is fluidly connected with the internal combustion chamber 610. On the other hand, when the pushing force by the valve driving mechanism 700 is not applied, the valve 1 is sit on a valve seat 601 formed in the cylinder head 600 by the biasing force of the coil spring 60 so that the corresponding gas line 620, 630 is fluidly disconnected with the combustion chamber 610.

Specifically, the fuel gas supply line 620 and the fuel gas discharge line 630 are fluidly connected with the combustion chamber 610 through ports 620P, 630P, respectively.

The valve 1 is mounted at the cylinder head 600 in a movable manner along the axial line direction X so as to close the corresponding port 620P, 630P when sitting on the valve seat 601 and open the corresponding port 620P, 630P when positioning away from the valve seat 601.

Figure 2:
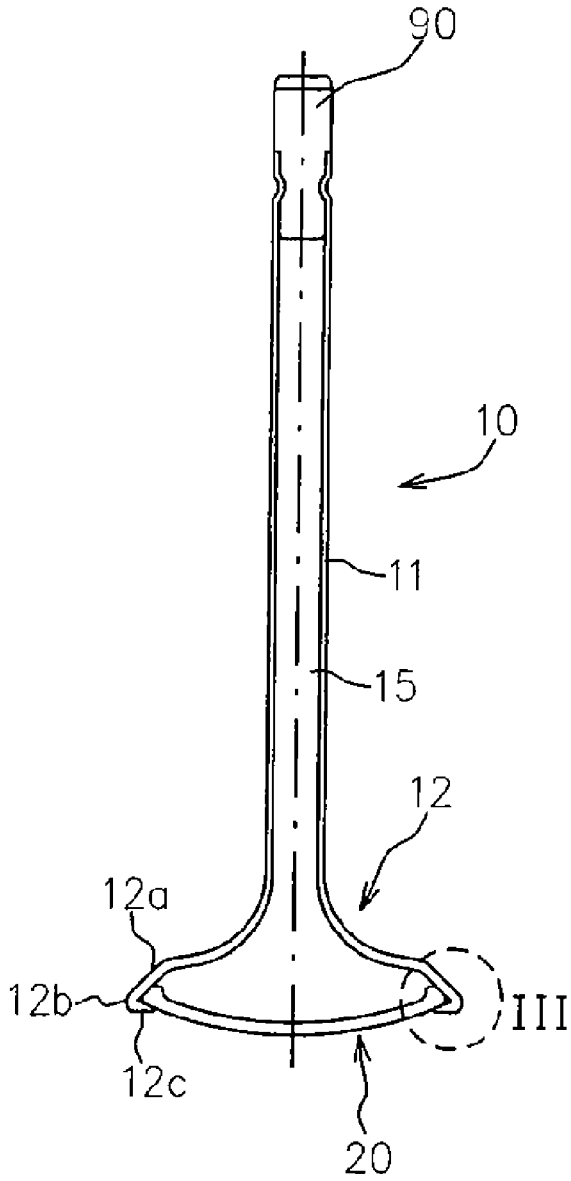
FIG. 2 is a longitudinal cross sectional view of a valve of the valve structure for internal combustion shown in FIG. 1.

FIG. 2 shows a longitudinal cross sectional view of the valve 1.

As shown in FIGS. 1 and 2, the valve 1 has a hollow stem member 10 and a lid member 20 connected to the stem member 10.

The stem member 10 includes a shaft portion 11 that is directly or indirectly inserted in a movable manner along the axis line direction into an axial line hole formed in the cylinder head 600, a flare portion 12 that extends from one side of the shaft portion 11 toward the combustion chamber 610, and a hollow portion 15 of which the flare portion 12 is an open end.

In the present embodiment, the shaft portion 11 is inserted in a movable manner along the axis line direction into a hollow valve guide 650 (see FIG. 1) fixedly provided in the axis line hole. A seal member 660 seals between an upper opening end of an axial line hole of the valve guide 650 and the shaft portion 11. The stem member 10 may be formed by drawing a plate shaped member of steel, heat resisting steel, stainless, titanium alloy and the like.

Reference number 90 in FIGS. 1 and 2 designates a plug inserted into an external end of the shaft portion 11 to close an end on a side opposite the open end of the hollow portion 15. The plug 90 is caulked while being inserted into the hollow portion 15 of the shaft portion 11.

The lid member 20 is coupled to the stem member 10 by caulking so as to close the hollow portion 15 of the stem member 10.

In a state after the lid member 20 is coupled to the stem member 10 by caulking, the flare portion 12 of the stem member 10 has an enlarged diameter portion 12*a* having a diameter becoming larger as extending towards the one side (i.e., the open end side of the hollow portion 15) with the axial line X of the shaft portion 11 as the reference, and a reduced diameter portion 12*c* extending from the enlarged diameter portion 12*a* toward the one side with a flexion point 12*b* in between.

The reduced diameter portion 12*c* is configured to intersect the enlarged diameter portion 12*a* in a longitudinal cross sectional view.

That is, the enlarged diameter portion 12*a* and the reduced diameter portion 12*c* are configured so that an outline in the longitudinal cross sectional view of the enlarged diameter portion 12*a* and an outline in the longitudinal cross sectional view of the reduced diameter portion 12*c* intersect at a predetermined angle rather than being substantially parallel. The lid member 20 is sandwiched by the enlarged diameter portion 12*a* and the reduced diameter portion 12*c*, as shown in FIG. 2

The valve 1 with the configuration could effectively prevent the pressure of the hollow portion 15 from being raised during the combusting operation of the internal combustion, while reducing the weight by making the stem member 10 into the hollow shape.

Specifically, since the valve 1 is arranged so as to face the combustion chamber 610, the valve 1 is normally exposed to high temperature of about 450° C. when provided in the fuel gas supply line 620 and of about 800° C. when provided in the fuel gas discharge line 630 during the combusting operation of the internal combustion engine.

Therefore, the stem member 10 may tend to elastically deform in such a manner that the hollow portion 15 expands by the rise of the internal pressure of the hollow portion 15 due to the rise of temperature.

In particular, in a case where the thickness of the stem member 10 is made thin in order to reduce the weight of the stem member 10, such risk becomes higher.

In this regards, the valve 1 is configured so that the lid member 20 is coupled to the flare portion 12 of the stem member 10 by caulking so as to be sandwiched by the enlarged diameter portion 12*a* and the reduced diameter portion 12*c*, and the reduced diameter portion 12*c* intersects the enlarged diameter portion 12*a* in the longitudinal cross sectional view after caulking.

With such a configuration, when the valve 1 is exposed to high temperature during the combusting operation of the internal combustion engine, the flexion point 12*b* between the enlarged diameter portion 12*a* and the reduced diameter portion 12*c* thermally expands radially outward with the axial line X of the shaft portion 11 as the reference, whereby a gap, which fluidly connects the hollow portion 15 to outside, is created between the stem member 10 and the lid member 20.

Therefore, the rise of the internal pressure of the hollow portion 15 due to the temperature rise could be effectively prevented, thereby preventing the elastic deformation of the stem member 10 due to the temperature rise.

Furthermore, in the present embodiment, the valve 1 is configured so as to relieve the internal pressure of the hollow portion 15 to outside through the gap that opens to the combustion chamber 610. Therefore, it is possible to suppress the internal pressure rise of the hollow portion 15 while effectively preventing the engine oil from being mixed into the valve 1 and preventing the valve 1 from being damaged.

Specifically, if an internal pressure escape hole is provided in the vicinity at the other end (an end on a side opposite the flare portion 12) of the shaft portion 11, the engine oil may flow into the hollow portion 15 of the valve 1.

If the internal pressure escape hole is provided at the portion lying from the shaft portion 11 to the flare portion 12, the vicinity of the internal pressure escape hole becomes a stress concentration area, whereby the stem member 10 may be broken.

On the other hand, the valve 1 is configured so that the gap created between the stem member 10 and the lid member 20 is used as the internal pressure escape hole. That is, in the valve 1, the internal pressure escape hole is positioned in the combustion chamber 610. Therefore, it is possible to suppress the rise of the internal pressure of the hollow portion 15 while effectively preventing the engine oil from being mixed into the valve 1 and preventing the valve 1 from being damaged.

The reduced diameter portion 12*c* is preferably formed so as to approach the axial line X of the shaft portion 11 as extending towards the one side (i.e., a free end side) in the longitudinal cross sectional view.

According to such a configuration, the flexion point 12*b* easily expands radially outward with the axial line X of the shaft portion 11 as the reference during thermal expansion of the stem member 10, whereby the gap is more reliably obtained.

Preferably, the stem member 10 may be formed of a material having a thermal expansion coefficient larger than that of the lid member 20.

For example, the stem member 10 may be formed of SUS305 (linear thermal expansion coefficient $16\times10^{-6}$° C. in a temperature range of 0° C. to 100° C.), and the lid member 20 may be formed by SUH3 (linear thermal expansion coefficient $11\times10^{-6}$° C. in a temperature range of 0° C. to 100° C.).

By forming the stem member 10 with a material that tends to thermally expand more easily than the lid member 20 as described above, the gap could be reliably formed between the stem member 10 and the lid member 20 in the combusting operation of the internal combustion engine.

The coil spring 60 is configured so as to bias the valve 1 toward a blocking direction that is the other side along the axis line direction, as shown in FIG. 1.

Specifically, the coil spring 60 has a proximal end held at an outer surface of the cylinder head 600 and a distal end held at a holding member 50 that is provided at the shaft portion 11.

In the present embodiment, the coil spring 60 has an enlarged diameter portion 61 extending from the proximal end toward the other side along the axial line direction so as to surround the valve guide 650, and a tapered portion 65 that has a diameter becoming smaller as extending from the enlarged diameter portion 61 toward the other side along the axial line direction and terminates at the distal end.

The enlarged diameter portion 61 has an inner diameter larger than the outer diameter of the valve guide 650.

The tapered portion 65 is configured so that the inner diameter at the distal end is smaller than the outer diameter of the valve guide 650.

In the present embodiment, as described above, the inner diameter of the enlarged diameter portion 61 on a proximal end side is larger than the outer diameter of the valve guide 650 so that the coil spring 60 and the valve guide 650 are prevented from being interfered with each other, while the inner diameter of the distal end of the coil spring 60 is smaller than the outer diameter of the valve guide 650 so that the distal end of the coil spring 60 is as close to the shaft portion 11 of the valve 1 as possible.

That is, in the present embodiment, the valve structure 100 is configured so that a holding position at which the distal end of the coil spring 60 is held is positioned radially inward as much as possible with the axial line X of the shaft portion 11 as the reference, thereby compacting and lightening the holding member 50 for holding the distal end of the coil spring 60.

The valve structure for internal combustion 100 is configured so as to selectively open or close the corresponding port 620P, 630P by the valve driving mechanism 700, as described above.

Specifically, the driving mechanism 700 includes a driving shaft 710 rotated about its axis line and a cam member 720 rotated by the driving shaft 710.

The valve 1 is configured to take an opening position where the corresponding port 620P, 630P is fluidly connected to the combustion chamber 610 when the cam member 720 operatively pushes the valve 1 toward one side along the axial line direction (a direction towards the combustion chamber 610) against the biasing force of the coil spring 60, and a blocking position where the corresponding port 620P, 630P is closed with respect to the combustion chamber 610 by the biasing force of the coil spring 60 when the pushing force by the cam member 720 is not applied.

FIG. 1 shows a state in which both the fuel gas supply line 620 and the fuel gas discharge line 630 are blocked with respect to the combustion chamber 610 by the corresponding valve 1.

The valve structure for internal combustion 100 according to the present embodiment has a following configuration in addition to the above configuration, in order to effectively prevent the valve from elastically deforming toward the other side along the axis line direction due to the rise of the internal pressure of the combustion chamber 610 during the combusting operation of the internal combustion 500.

Figure 3:
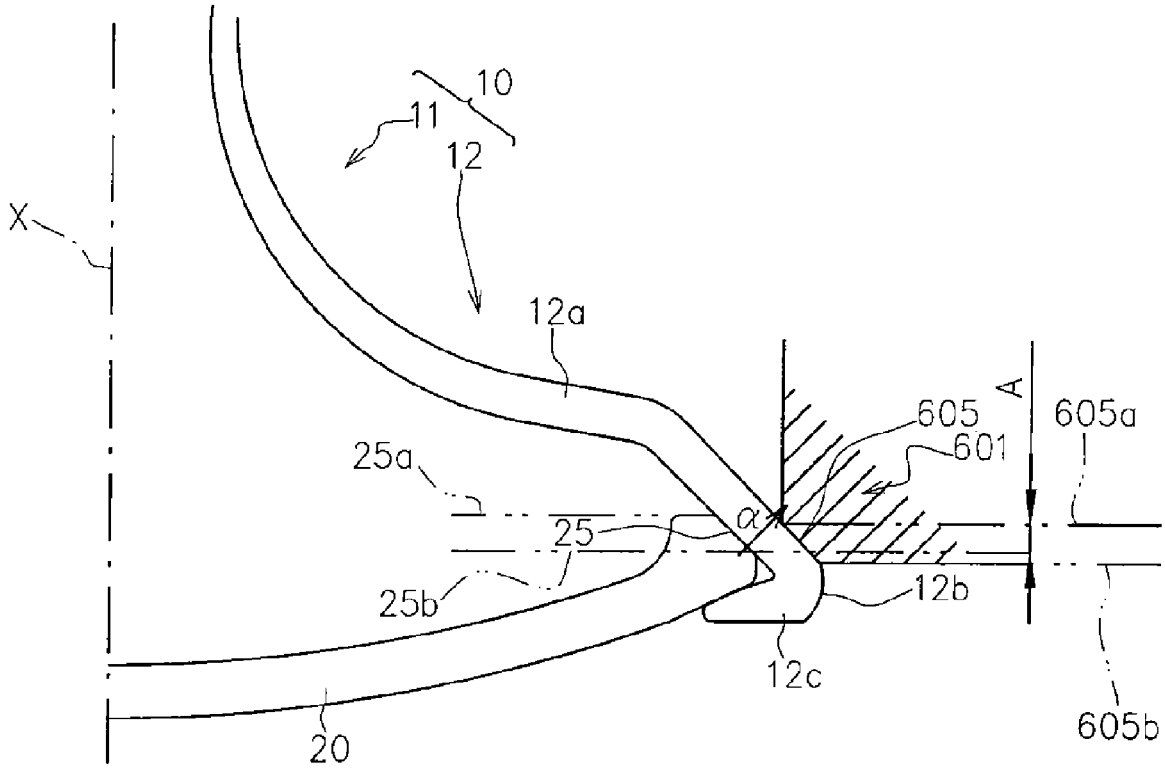
FIG. 3 is an enlarged view of a part III in FIG. 2.

FIG. 3 shows an enlarged view of a part III in FIG. 2.

As shown in FIG. 3, the valve seat 601 and the outer peripheral surface of the enlarged diameter portion 12*a* are configured so as to contact each other at a sealing region 605 extending between a combustion-chamber-side end portion 605*b* on one side along the axis line direction (on a side close to the combustion chamber 610) and a gas-line-side end portion 605*a* on the other side along the axis line direction (on a side away from the combustion chamber 610).

The lid member 20 and the inner peripheral surface of the enlarger diameter portion 12*a* are configured so as to contact each other at a connecting region 25 extending between a combustion-chamber-side end portion 25*b* on one side along the axis line direction (on a side close to the combustion chamber 610) and a gas-line-side end portion 25*a* on the other side along the axis line direction (on a side away from the combustion chamber 610).

The connecting region 25 preferably has a length equal to or more than 1 mm.

In this configuration, the valve structure 100 according to the present invention is configured so that the gas-line-side end portion 605*a* of the sealing region 605 is positioned at a position same as or on the other side (on a side away from the combustion chamber 610) than the combustion-chamber-side end portion 25*b* of the connecting region 25 with respect to the axis line direction, as shown in FIG. 3, thereby effectively preventing the stem member 10 from elastically deforming toward the other side along the axis line direction (i.e., the direction away from the combustion chamber 610) during the combusting operation of the internal combustion engine 500.

That is, the internal pressure of the combustion chamber 610 is normally raised to about 80 atm at the combusting operation. Occasionally, pressure directing from the one side to the other side along the axis line direction applies to the lid member 20 disposed so as to be exposed in the combustion chamber 610. Consequently, the lid member 20 elastically deforms so as to bend toward the other side along the axis line direction and expand radially outward.

As described above, if the lid member 20 expands radially outward, the force having a direction orthogonal to the connecting region 25 (a direction of arrow a in FIG. 3) applies to the enlarged diameter portion 12*a* since the lid member 20 is sandwiched by the enlarged diameter portion 12*a* having a diameter becoming larger as extending toward the one side along the axis line direction and the reduced diameter portion 12*c* extending toward the one side from the enlarged diameter portion 12*a*.

When such force applies from the lid member 20 to the enlarged diameter portion 12*a*, the stem member 10 tries to elastically deform toward the other side along the axis line direction (i.e., the direction away from the combustion chamber 610).

In this regards, in the present embodiment, the gas-line-side end portion 605*a* on the other side along the axis line direction of the sealing region 605 is positioned at a position same as or on the other side (on a side away from the combustion chamber 610) than the combustion-chamber-side end portion 25*b* on the one side along the axis line direction of the connecting region 25.

According to the configuration, the elastic deformation toward a radially outward direction out of the elastic deformation of the lid member 20 due to the rise of the internal pressure of the combustion chamber 610 could be effectively prevented by the sealing region 605, thereby preventing the stem member 10 from elastically expanding toward the other side along the axis line direction.

Consequently, it is possible to effectively prevent unintentional force from applying from the valve 1 to the valve driving mechanism 700, while shortening the clearance between the outer end of the valve 1 and the valve driving mechanism 700 to enhance the quietness when the valve driving mechanism 700 operates.

The effect could be confirmed by an analysis based on a finite element method.

Figure 4:
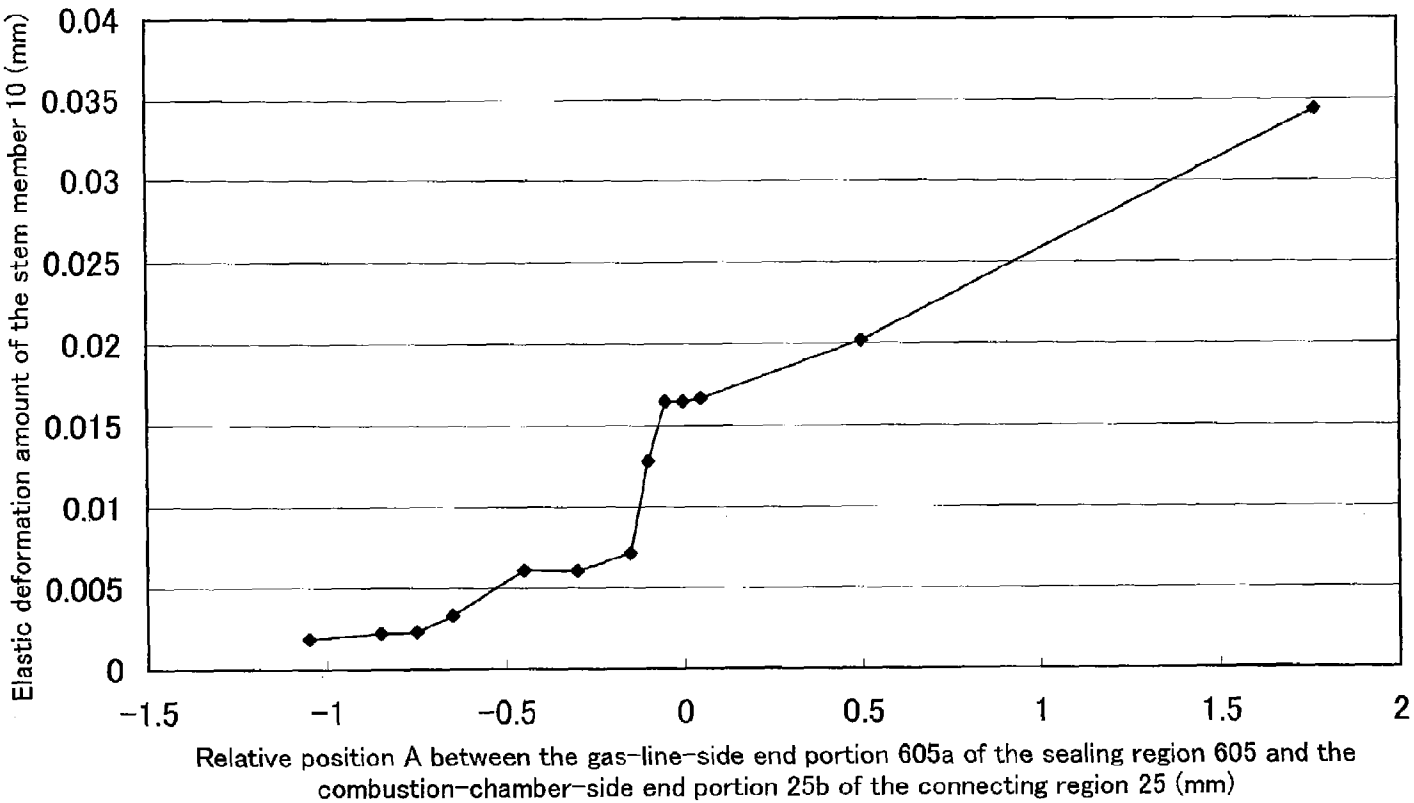
FIG. 4 is a graph showing an analysis result based on a finite element method with respect to an elastic deformation amount of a stem member of the valve structure for internal combustion according to the embodiment of the present invention.

FIG. 4 shows an analysis result based on the finite element method with respect to a changing proportion of an elastic deformation amount of a stem member 10 when an axial line direction length "A" between the gas-line-side end portion 605*a* of the sealing region 605 and the combustion-chamber-side end portion 25*b* of the connecting region 25 is changed.

In FIG. 4, A=0 means that the gas-line-side end portion 605*a* of the sealing region 605 is positioned at the same position as the combustion-chamber-side end portion 25*b* of the connecting region 25 with respect to the axis line direction, A<0 means that the gas-line-side end portion 605*a* is positioned on the other side along the axis line direction (on the side away from the combustion chamber 610) than the combustion-chamber-side end portion 25*b*, and A>0 means that the gas-line-side end portion 605*a* is positioned on the one side along the axis line direction (on the side close to the combustion chamber 610) than the combustion-chamber-side end portion 25*b*.

As apparently from FIG. 4, it is possible to reduce the elastic deformation amount (pushing-up amount) of the stem member 10 by positioning the gas-line-side end portion 605*a* of the sealing region 605 at a position same as the combustion-chamber-side end portion 25*b* of the connecting region 25 or away from the combustion chamber 610 than the combustion-chamber-side end portion 25*b*.

The valve structure for internal combustion 100 according to the present embodiment is configured so that a gap exists between the stem member 10 and the lid member 20 during the combusting operation of the internal combustion 500.

With the configuration, the gap could effectively prevent the internal pressure of the hollow portion 15 from being raised even if the lid member 20 elastically deforms so as to bend due to the internal pressure of the combustion chamber 610.

The gas-line-side end portion 605*a* of the sealing region 605 may be preferably positioned at a position same as the gas-line-side end portion 25*a* of the connecting region 25 with respect to the axis line direction or on the other side along the axis line direction (on a side away from the combustion chamber 610) than the gas-line-side end portion 25*a*.

According to the configuration, the elastic deformation toward a radially outward direction of the lid member 20 could be more effectively prevented by the sealing region 605, thereby more effectively preventing the expansion toward the other side along the axis line direction of the stem member 10.

Figure 5:
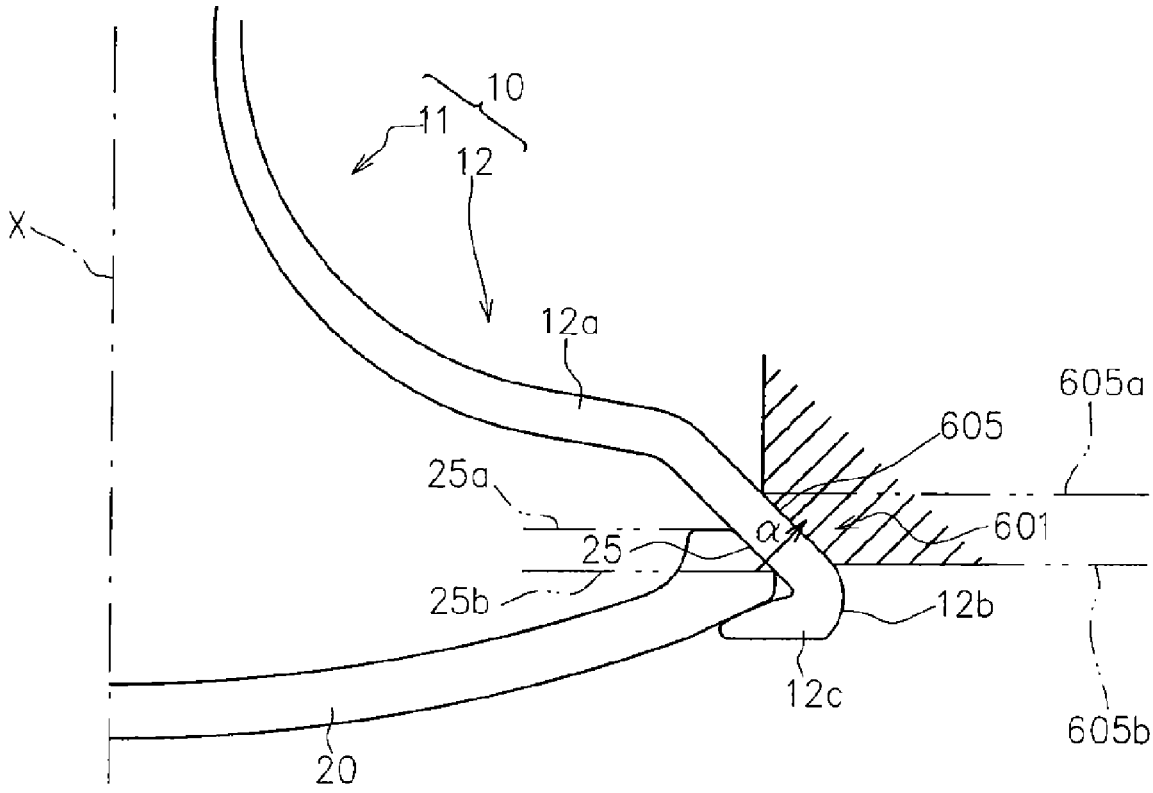
FIG. 5 is a partial longitudinal cross sectional view of a modified embodiment of the valve structure for internal combustion according to the embodiment.

In the configurations shown in FIGS. 3 and 5, the combustion-chamber-side end portion 605*b* of the sealing region 605 may be preferably positioned closer to the combustion chamber 610 along the axis line direction than the gas-line-side end portion 25*a* of the connecting region 25 (see FIG. 5), thereby more effectively preventing the elastic deformation toward the radially outward direction of the lid member 20.

Furthermore, in the configuration where the combustion-chamber-side end portion 605*b* of the sealing region 605 is positioned closer to the combustion chamber 610 along the axis line direction than the gas-line-side end portion 25*a* of the connecting region 25, the combustion-chamber-side end portion 605*b* of the sealing region 605 may be preferably positioned farther from the combustion chamber 610 along the axis line direction than the combustion-chamber-side end portion 25*b* of the connecting region 25 (see FIG. 5), thereby compacting the valve seat 601 as small as possible while preventing the elastic deformation toward the other side along the axis line direction of the valve 1.

Figure 6:
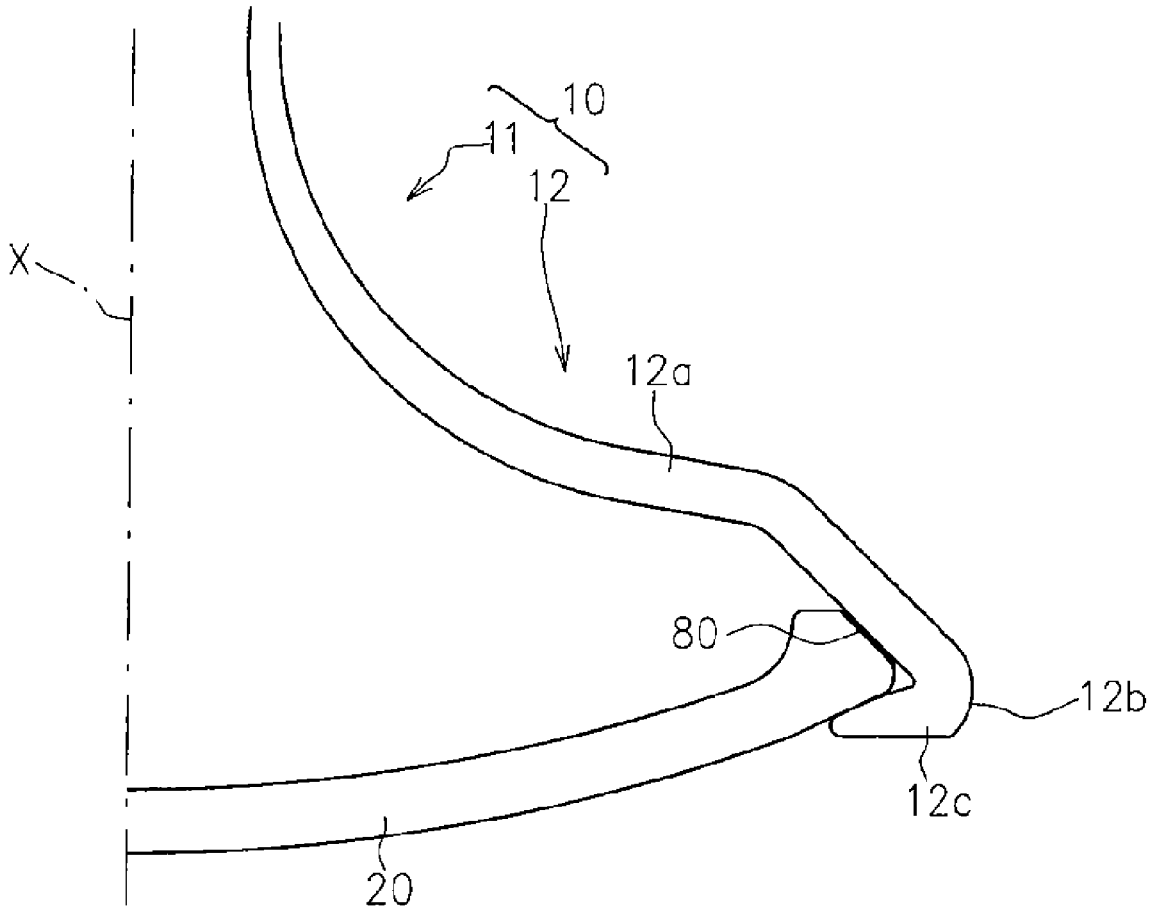
FIG. 6 is a partial longitudinal cross sectional view of another modified embodiment of the valve structure for internal combustion according to the embodiment.

Further, in the above various configurations, a ring-shaped buffering member 80 may be preferably provided between the lid member 20 and the internal peripheral surface of the enlarged diameter portion 12*a* as shown in FIG. 6.

By providing the buffering member 80, the buffering member 80 could absorb the elastic deformation toward the radially outward direction of the lid member 20, thereby effectively preventing the elastic deformation toward the radially outward direction of the lid member 20 from influencing the stem member 10.

More preferably, the buffering member 80 may be formed of a material having a surface hardness smaller than those of the stem member 10 and the lid member 20. For example, heat-resisting plastic, copper containing alloy, aluminum containing alloy and lead containing alloy are explained as examples of the preferable material of the buffering member 80.

The valve 1 preferably includes a powder coolant (not shown) accommodated within the hollow portion 15 that is defined by the stem member 10 and the lid member 20.

The valve 1 with the powder coolant 30 may be formed by coupling the lid member 20 to the stem member 10 by caulking in a state where the powder coolant has been accommodated in advance in the hollow portion 15 of the stem member.

A powder body of aluminum nitride or ceramics having an average particle diameter of 1 μm or more may be used as the powder coolant.

It is possible to effectively reduce the temperature rise of the valve 1 by providing the powder coolant.

However the lid member 20 is configured to be coupled to the flare portion 12 only by caulking in the present embodiment, the lid member 20 could be coupled to the flare portion 12 by welding a part of the peripheral edge of the lid member 20 to the flare portion 12 as long as the gap is created between the lid member 20 and the flare portion 12 thanks to the thermal expansion in the combusting operation of the internal combustion 500.

This specification is by no means intended to restrict the present invention to the preferred embodiment and the modified embodiment set forth therein. Various modifications to the valve structure for internal combustion may be made by those skilled in the art without departing from the spirit and scope of the present invention as defined in the appended claims.

What is claimed is:

1. A valve structure for internal combustion comprising a valve mounted at a cylinder head in a movable manner along an axis line direction so as to cut off between a combustion chamber and a gas line when sitting on a valve seat provided at the cylinder head and fluidly connect the combustion chamber and the gas line when being away from the valve seat, and a coil spring biasing the valve toward the valve seat, the valve structure being configured so as to fluidly connect the combustion chamber and the gas line when a valve driving mechanism that is disposed so as to push an external end on a side opposite the combustion chamber of the valve moves the valve toward a side close to the combustion chamber against a biasing force of the coil spring, and fluidly disconnect the combustion chamber and the gas line when the pushing force by the valve driving mechanism is not applied to the valve and the valve is seated on the valve seat by the biasing force of the coil spring, wherein;

the valve has a hollow stem member including a shaft portion that is directly or indirectly inserted in a movable manner along the axis line direction into an axial line hole formed in the cylinder head and a flare portion that extends toward a side close to the combustion chamber and that has a free end being an open end, and a lid member connected to the stem member by caulking so as to close the open end;

the flare portion includes an enlarged diameter portion having a diameter becoming larger as extending toward the side close to the combustion chamber and configured so that an outer peripheral surface is capable of contacting the valve seat, and a reduced diameter portion extending from the enlarged diameter portion toward the side close to the combustion chamber with a flexion point in between;

the lid member is sandwiched by the enlarged diameter portion and the reduced diameter portion;

the valve seat and the outer peripheral surface of the enlarged diameter portion are brought into contact with each other at a sealing region extending between a combustion-chamber-side end portion that is positioned on a side close to the combustion chamber and a gas-line-side end portion that is positioned on a side away from the combustion chamber;

the lid member and an inner peripheral surface of the enlarged diameter portion are brought into contact with each other at a connecting region extending between a combustion-chamber-side end portion that is positioned on a side close to the combustion chamber and a gas-line-side end portion that is positioned on a side away from the combustion chamber; and the gas-line-side end portion of the sealing region is positioned the same as the combustion-chamber-side end portion of the connecting region with respect to the axis line direction or is positioned farther away from the combustion chamber than the combustion-chamber-side end portion of the connecting region, and the combustion-chamber-side end portion of the sealing region is positioned closer to the combustion chamber than the gas-line-side end portion of the connecting region.

2. A valve structure for internal combustion according to claim 1, wherein the gas-line-side end portion of the sealing region is positioned the same as the gas-line-side end portion of the connecting region with respect to the axis line direction or is positioned farther away from the combustion chamber than the gas-line-side end portion of the connecting region.

3. A valve structure for internal combustion according to claim 2 further comprising a buffering member inserted between the lid member and the internal peripheral surface of the enlarged diameter portion, the buffering member capable of absorbing the elastic deformation toward the radially outward direction of the lid member.

4. A valve structure for internal combustion according to claim 1 further comprising a buffering member inserted between the lid member and the internal peripheral surface of the enlarged diameter portion, the buffering member capable of absorbing the elastic deformation toward the radially outward direction of the lid member.

5. A valve structure for internal combustion according to claim 1 further comprising a powder coolant accommodated in an internal space defined by the stem member and the lid member.

* * * * *